US008272727B2

(12) United States Patent
Jones et al.

(10) Patent No.: US 8,272,727 B2
(45) Date of Patent: Sep. 25, 2012

(54) MECHANIZED FEED CHANNEL BARRIER IN A SOLID INK PRINTER

(75) Inventors: Brent Rodney Jones, Sherwood, OR (US); Brian Walter Aznoe, Sherwood, OR (US)

(73) Assignee: Xerox Corporation, Norwalk, CT (US)

( * ) Notice: Subject to any disclaimer, the term of this patent is extended or adjusted under 35 U.S.C. 154(b) by 863 days.

(21) Appl. No.: 12/030,995

(22) Filed: Feb. 14, 2008

(65) Prior Publication Data

US 2009/0207219 A1 Aug. 20, 2009

(51) Int. Cl.
*B41J 2/175* (2006.01)

(52) U.S. Cl. ..... 347/88; 209/509

(58) Field of Classification Search ..... 347/84–88; 209/509

See application file for complete search history.

(56) References Cited

U.S. PATENT DOCUMENTS

| | | | | |
|---|---|---|---|---|
| 1,712,700 | A * | 5/1929 | Hardenbergh | 209/595 |
| 3,838,411 | A * | 9/1974 | Vander Meer | 340/538 |
| 4,117,975 | A * | 10/1978 | Gunn | 235/494 |
| 5,223,860 | A | 6/1993 | Loofbourow et al. | |
| 5,442,387 | A | 8/1995 | Loofbourow et al. | |
| 5,510,821 | A | 4/1996 | Jones et al. | |
| 5,734,402 | A | 3/1998 | Rousseau et al. | |
| 5,794,789 | A * | 8/1998 | Payson et al. | 209/549 |
| 5,861,903 | A | 1/1999 | Crawford et al. | |
| 6,056,394 | A | 5/2000 | Rousseau et al. | |
| 6,543,867 | B1 | 4/2003 | Jones | |
| 6,572,225 | B1 | 6/2003 | Jones | |
| 6,679,591 | B2 | 1/2004 | Jones | |
| 6,705,710 | B2 | 3/2004 | Jones et al. | |
| 6,709,094 | B2 | 3/2004 | Jones | |
| 6,719,413 | B2 | 4/2004 | Jones | |
| 6,722,764 | B2 | 4/2004 | Jones et al. | |
| 6,893,121 | B2 | 5/2005 | Jones | |
| 6,986,570 | B2 | 1/2006 | Jones et al. | |
| 7,104,635 | B2 | 9/2006 | Jones | |
| 2002/0070149 | A1 * | 6/2002 | Schererz et al. | 209/540 |
| 2004/0245157 | A1 * | 12/2004 | Stone | 209/552 |
| 2007/0146452 | A1 * | 6/2007 | Rodriguez et al. | 347/99 |
| 2007/0296781 | A1 * | 12/2007 | Jones et al. | 347/88 |
| 2008/0136881 | A1 * | 6/2008 | Fairchild et al. | 347/88 |
| 2008/0165231 | A1 * | 7/2008 | Hiroki et al. | 347/86 |

* cited by examiner

*Primary Examiner* — Charlie Peng
*Assistant Examiner* — Peter Radkowski
(74) *Attorney, Agent, or Firm* — Maginot, Moore & Beck, LLP

(57) ABSTRACT

A method is implemented to control movement of a solid ink stick from an insertion port to a corresponding feed channel to help ensure that each feed channel in a plurality of feed channels contains only ink sticks corresponding to the feed channel. The method includes receiving solid ink sticks in an insertion port located at one end of a feed channel in the solid ink printer, identifying each ink stick received in the insertion port, and removing a passage barrier from the feed channel in response to the ink stick being identified as corresponding to ink configured for passage through the feed channel.

20 Claims, 5 Drawing Sheets

MECHANIZED FEED CHANNEL BARRIER IN A SOLID INK PRINTER

TECHNICAL FIELD

The mechanized feed channel barrier disclosed below generally relates to solid ink printers, and, more particularly, to solid ink printers having multiple feed channels.

BACKGROUND

Solid ink or phase change ink imaging devices, hereafter called solid ink printers, encompass various imaging devices, such as printers and multi-function devices. These printers offer many advantages over other types of image generating devices, such as laser and aqueous inkjet imaging devices. Solid ink or phase change ink printers conventionally receive ink in a solid form, either as pellets or as ink sticks. A color printer typically uses four colors of ink (yellow, cyan, magenta, and black).

The solid ink pellets or ink sticks, hereafter referred to as ink, sticks, or ink sticks, are delivered to a melting device, which is typically coupled to an ink loader, for conversion of the solid ink to a liquid. A typical ink loader includes multiple feed channels, one for each color of ink used in the imaging device. Each channel has an insertion opening in which ink sticks of a particular color are placed and then either gravity fed or urged by a conveyor or a spring-loaded pusher along the feed channel. Each feed channel directs the solid ink within the channel towards a melting device located at the end of the channel. Each melting device receives solid ink from the feed channel to which the melting device is connected and heats the solid ink impinging on it to convert the solid ink into liquid ink that is delivered to a print head for jetting onto a recording medium or intermediate transfer surface.

Each feed channel insertion opening may be covered by a key plate having a keyed opening. The keyed openings help ensure a printer user places ink sticks of the correct color in a feed channel. To accomplish this goal, each keyed opening has a unique shape. The ink sticks of the color corresponding to a particular feed channel have a shape corresponding to the shape of the keyed opening. The keyed openings and corresponding ink stick shapes exclude from each ink feed channel ink sticks of all colors except the ink sticks of the proper color for the feed channel. Unique keying shapes for other factors are also employed in keyed openings to exclude from a feed channel ink sticks that are formulated or intended for other printer models.

As the number of pages printed per minute increases for solid ink printers so does the demand for ink in the printer. To supply larger amounts of ink to printers, the cross-sectional area of the feed channels may be increased. Consequently, the insertion openings for the channels and the keyed plates covering the openings are likewise enlarged. These larger openings enable smaller solid ink sticks to pass through without engaging the keyed plates over the openings. Thus, solid ink sticks that do not conform to the appropriate color for a feed channel can be loaded into the feed channel and delivered to the melting device at the end of the feed channel. Even if the smaller stick is the correct color for the feed channel, its size may impair the ability of the stick to cooperate with guiding structure within the feed channel. Thus, excluding ink sticks that are not configured for use in a feed channel is a desirable goal.

SUMMARY

A method is implemented to control movement of a solid ink stick from an insertion port to a corresponding feed channel to help ensure that each feed channel in a plurality of feed channels contains only ink sticks configured for use in the feed channel. The method includes receiving solid ink sticks in an insertion port located at one end of a feed channel in the solid ink printer, identifying each ink stick received in the insertion port, and removing a passage barrier from the feed channel in response to the ink stick being identified as corresponding to ink configured for passage through the feed channel.

A system enables a solid ink printer to be operated with a reduced risk that inappropriate ink sticks are loaded into a feed channel. The system includes a plurality of feed channels, each feed channel having an insertion port at one end of the feed channel and a melting device that heats solid ink sticks to a melting temperature at another end of the feed channel, and each insertion port has at least one sensor to identify a solid ink stick received in the insertion port and an ink stick passage barrier configured to move into and out of the feed channel to block solid ink sticks from entering the feed channel from the insertion port.

BRIEF DESCRIPTION OF THE DRAWINGS

Features for enabling passage of solid ink from an insertion port at one end of a feed channel in a solid ink printer to the feed channel are discussed with reference to the drawings, in which.

DETAILED DESCRIPTION

Figure 1:
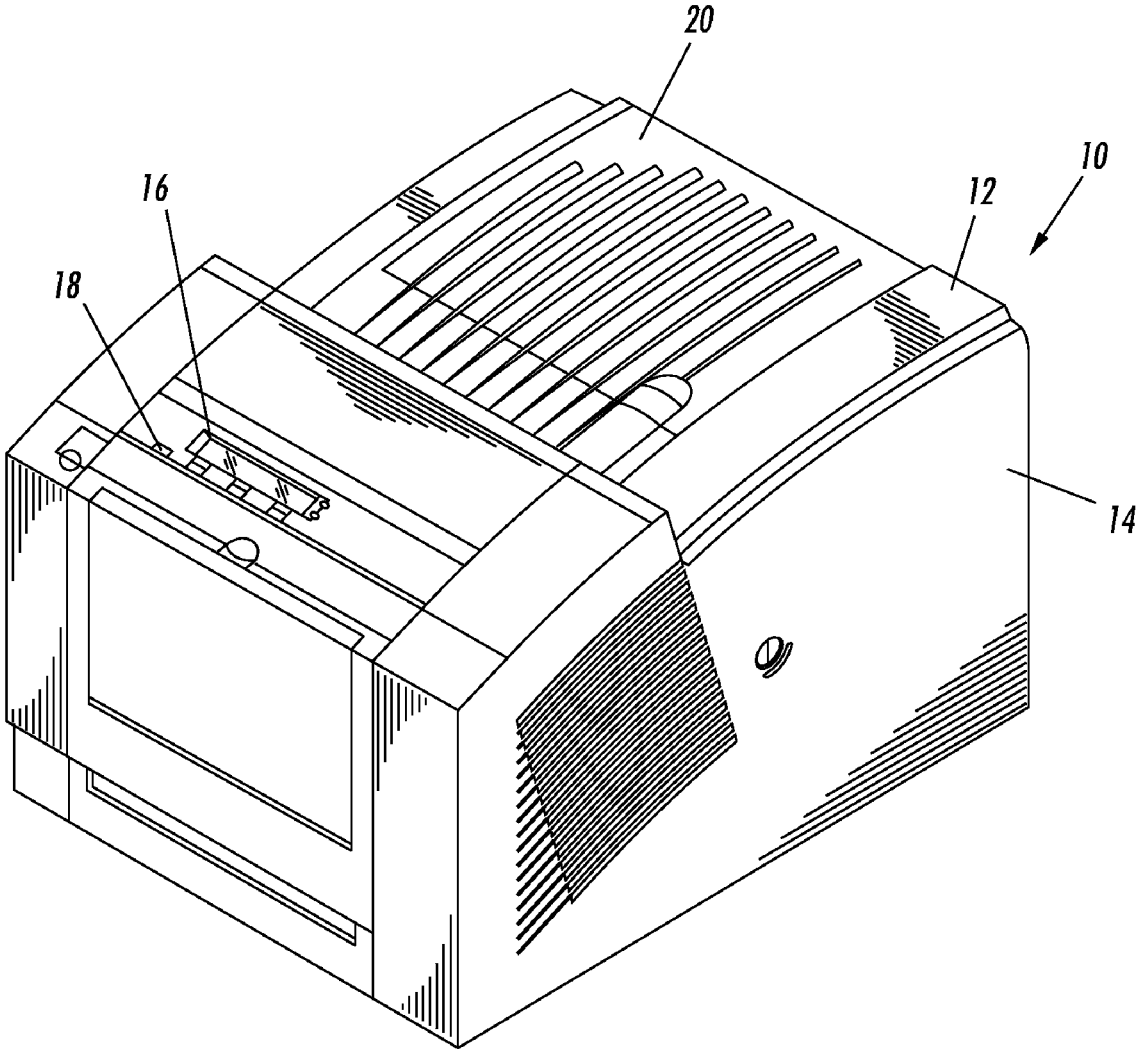
FIG. 1 PRIOR ART
FIG. 1 is a perspective view of an ink printer with the printer top cover closed.

The term "printer" refers, for example, to reproduction devices in general, such as printers, facsimile machines, copiers, and related multi-function products. A prior art solid ink printer having a solid ink transport system is shown in FIG. 1. A description of the ink loading system for that printer is presented to provide a background for understanding the system described more fully below that selectively blocks solid ink sticks from entering a feed channel within a printer.

FIG. 1 shows an ink printer 10 that includes an outer housing having a top surface 12 and side surfaces 14. A user interface display, such as a front panel display screen 16, displays information concerning the status of the printer, and user instructions. Buttons 18 or other control actuators for controlling operation of the printer are adjacent the user interface window, or may be at other locations on the printer. An ink jet printing mechanism (not shown) is contained inside the housing. An ink feed system delivers ink to the printing mechanism. The ink feed system is contained under the top surface of the printer housing. The top surface of the housing includes a hinged ink access cover 20 that opens as shown in FIG. 2, to provide the user access to the ink feed system.

Figure 2:
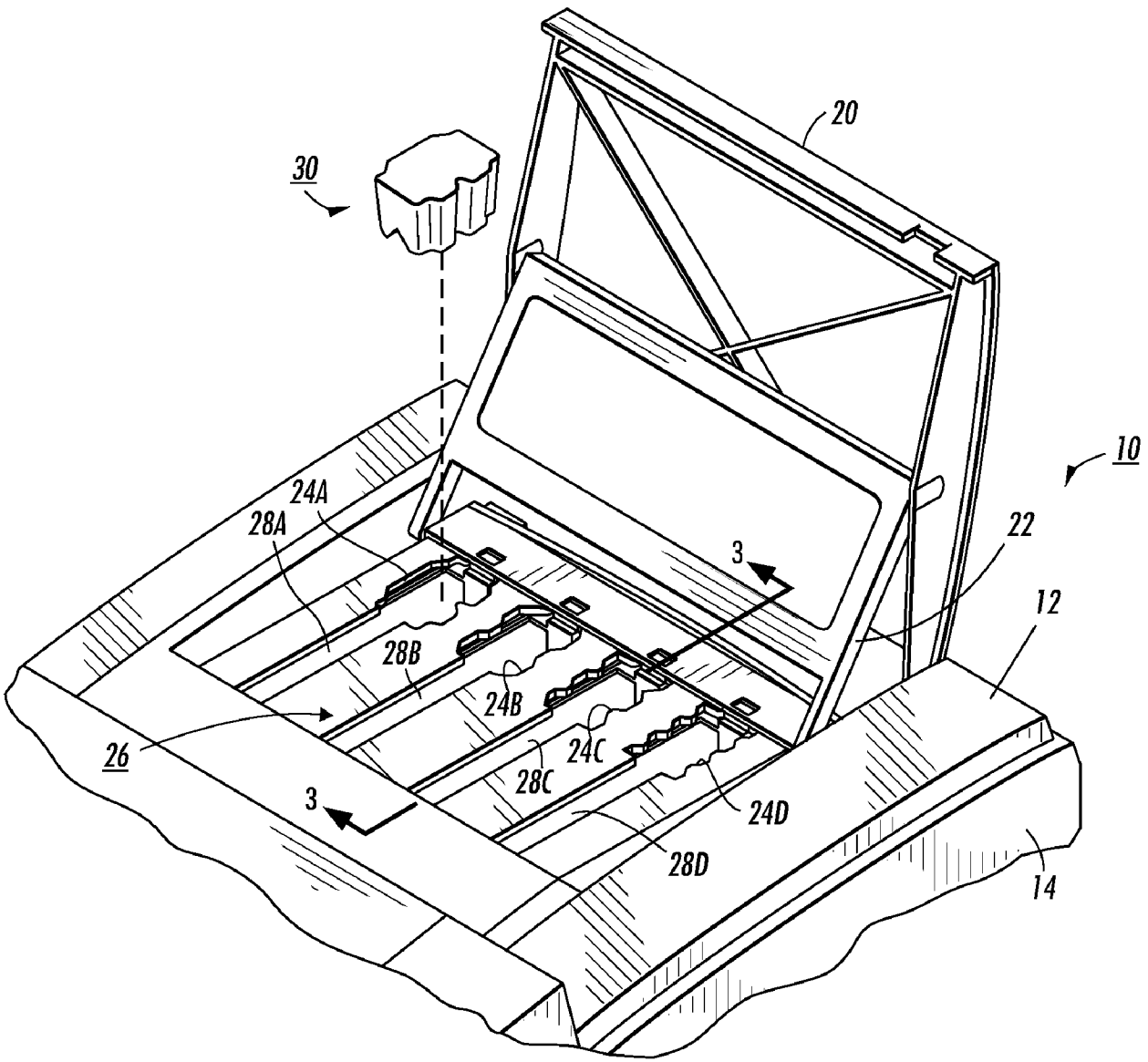
FIG. 2 PRIOR ART
FIG. 2 is an enlarged partial top perspective view of the ink printer with the ink access cover open, showing a solid ink stick in position to be loaded into a feed channel.

In the particular printer shown in FIG. 2, the ink access cover 20 is attached to an ink load linkage element 22 so that when the printer ink access cover 20 is raised, the ink load linkage 22 slides and pivots to an ink load position. The ink access cover and the ink load linkage element may operate as described in U.S. Pat. No. 5,861,903 for an Ink Feed System, issued Jan. 19, 1999 to Crawford et al. As seen in FIG. 2, opening the ink access cover reveals a key plate 26 having keyed openings 24A-D. Each keyed opening 24A, 24B, 240, 24D provides access to an insertion end of one of several individual feed channels 28A, 28B, 28C, 28D of the solid ink feed system.

A color printer typically uses four colors of ink (yellow, cyan, magenta, and black). Ink sticks 30 of each color are delivered through a corresponding individual one of the feed channels 28A-D. The operator of the printer exercises care to avoid inserting ink sticks of one color into a feed channel for a different color. Ink sticks may be so saturated with color dye that it may be difficult for a printer user to tell by color alone which color is which. Cyan, magenta, and black ink sticks in particular can be difficult to distinguish visually based on color appearance. The key plate 26 has keyed openings 24A, 24B, 240, 24D to aid the printer user in ensuring that only ink sticks of the proper color are inserted into each feed channel. Each keyed opening 24A, 24B, 240, 24D of the key plate has a unique shape. The ink sticks 30 of the color for that feed channel have a shape corresponding to the shape of the keyed opening. The keyed openings and corresponding ink stick shapes exclude from each ink feed channel ink sticks of all colors except the ink sticks of the proper color for that feed channel.

Figure 3:
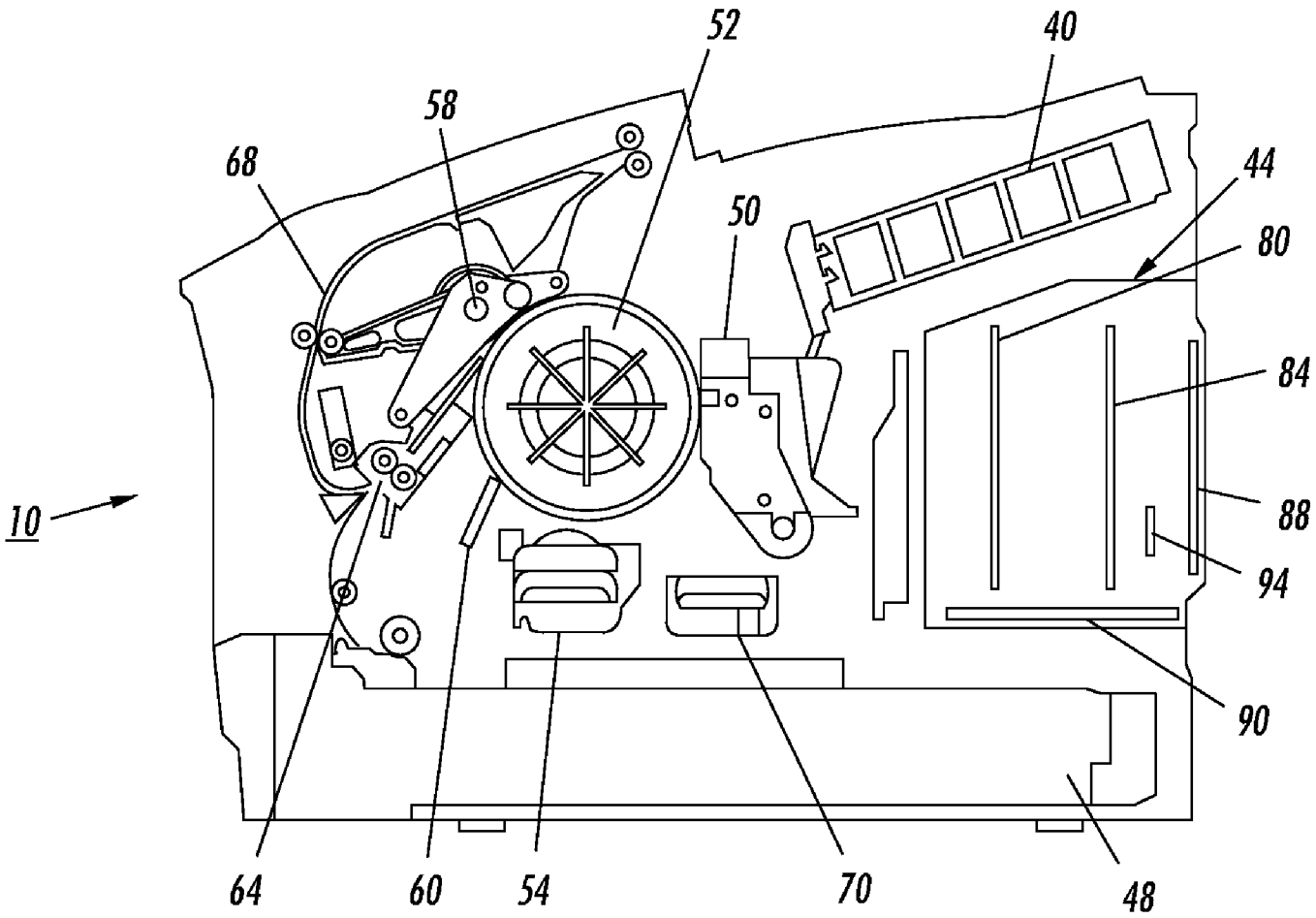
FIG. 3 PRIOR ART
FIG. 3 is a side view of the ink printer shown in FIG. 2 depicting the major subsystems of the ink printer.

As shown in FIG. 3, the ink printer 10 may include an ink loading subsystem 40, an electronics module 44, a paper/media tray 48, a print head 50, an imaging member 52 having an intermediate imaging surface (not visible), a drum maintenance subsystem 54, a transfer subsystem 58, a wiper subassembly 60, a paper/media preheater 64, a duplex print path 68, and an ink waste tray 70. In brief, solid ink sticks 30 are loaded into ink loader 40 through which they travel to a melting device (not shown). At the melting device, the ink stick is melted and the liquid ink is delivered to a reservoir in the print head 50. The ink is ejected by piezoelectric elements through apertures in the print head 50 to form an image on the imaging surface of the imaging member 52 as the member rotates. An imaging member heater is controlled by a controller to maintain the imaging member within an optimal temperature range for generating an ink image and transferring it to a sheet of recording media. A sheet of recording media is removed from the paper/media tray 48 and directed into the paper pre-heater 64 so the sheet of recording media is heated to a more optimal temperature for receiving the ink image. A synchronizer delivers the sheet of the recording media so its movement between the transfer roller in the transfer subsystem 58 and the image member 52 is coordinated for the transfer of the image from the imaging member to the sheet of recording media.

Figure 4:
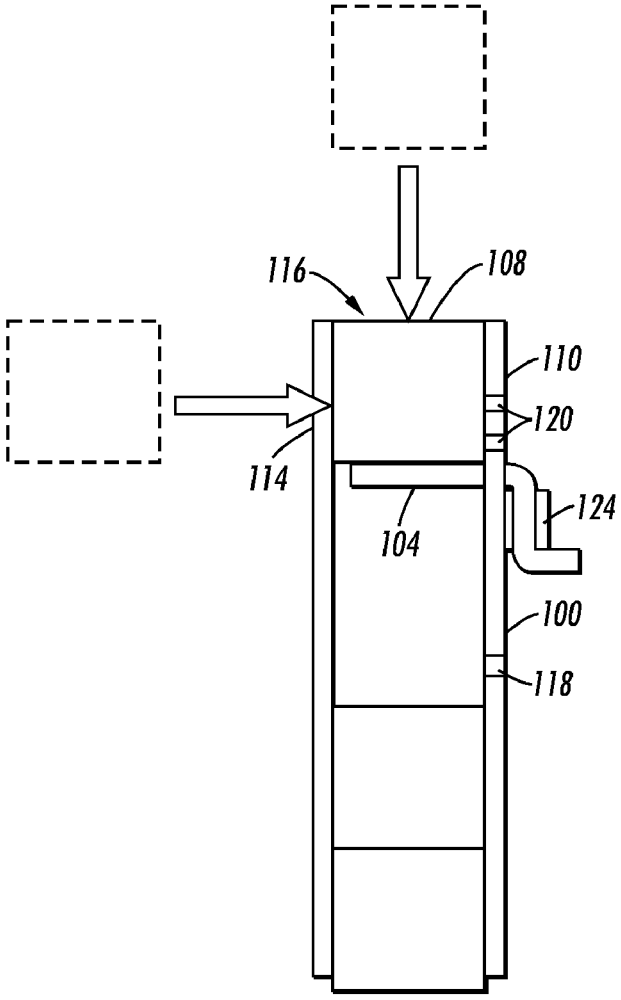
FIG. 4 is a side view of a vertically oriented feed channel having a passage barrier for selectively enabling ink sticks to enter the feed channel.

A feed channel 100 having a passage barrier 104 that selectively blocks an ink stick 108 from exiting the insertion port 110 to enter the feed channel 100 is shown in FIG. 4. As shown in FIG. 4, an entrance to the insertion port 110 may be positioned to be transverse to the direction of solid ink stick movement through the feed channel, such as entrance 114, or it may be aligned with the direction of solid ink stick movement through the feed channel, such as entrance 116. The insertion port 110 may be provided with a hinged or other displaceable cover (not shown) that may be opened to expose the insertion port 110 for solid ink stick insertion. In one embodiment, moving the cover to expose the port 110 generates a signal to activate the ink stick identification process described below. Alternatively, a key plate or the like may be placed over the entrance to the insertion port 110 in an effort to limit the solid ink sticks that may be inserted into a port 110. As noted above, however, key plates may not be able to prevent ink sticks that are not the appropriate color or configuration from being inserted into previously known feed channels.

The feed channel 100 includes a passage barrier 104 that selectively blocks the feed channel from inappropriate ink sticks that may evade a key plate and enter an insertion port 110. The passage barrier 104 may be a planar platform, as shown in FIG. 4, or some other structure that is suitably shaped and dimensioned to block the entrance to the feed channel 100 and prevent a solid ink stick from entering the feed channel 100 while the passage barrier extends into the feed channel, as shown in FIG. 4. In the vertical orientation of the feed channel 100 shown in FIG. 4, the passage barrier 104 also supports the solid ink stick 108 that has been inserted in the port 110. The passage barrier 104 may be located in the port 110 to position the entire solid ink stick within the port 110 or it may be located in the port 110 to enable a portion of the ink stick to extend above the insertion port 110. The latter configuration may be useful to make removal of an ink stick from the port 110 easier. The barrier may range in blockage area from full to marginal obstruction for a given ink stick configuration. The amount of blockage is influenced from adequate to robust by available space, the range of ink sticks to be encountered, the cost and complexity of the barrier mechanism, and the like.

The port 110 includes one or more sensors 120 that obtain identification data from each ink stick inserted in the port. These data are compared to other data stored in the printer, as described in more detail below, to identify the ink sticks. Identification of an ink stick in the insertion port as corresponding to the feed channel coupled to the insertion port results in the passage barrier 104 being moved out of the feed channel so the ink stick is able to enter the feed channel. As shown in FIG. 4, the passage barrier 104 rotates within a bearing 124 to move out of the feed channel 100 to enable the ink stick 108 to enter the feed channel. Rotation of the passage barrier may be accomplished with an actuator (not shown), such as an electrical motor, that is coupled to one end of the passage barrier that lies outside the feed channel. The motor or other actuator may be selectively energized by a processor or other control component to rotate the passage barrier into and out of the feed channel. Alternatively, the passage barrier may slide into and out of the feed channel to control the entrance to the feed channel selectively. Yet another alternative embodiment uses a flexing barrier that retracts out of the feed path when it is rotated or translated with a moderate movement. Another sensor 118 is located in the feed channel at a position that is approximately one ink stick length from the passage barrier 104. The sensor 118 detects whether the feed channel 100 has been filled to a depth that would not enable another ink stick to move past the passage barrier by a distance that would enable the passage barrier to return to the blocking position. In response to a feed channel full signal from sensor 118, the processor or other control component does not enable the passage barrier to move from the blocking position regardless of the ink stick identification data read by the sensor 120.

Ink sticks not corresponding to the ink stick identification data result in the passage barrier remaining in a position that blocks the feed channel. Additionally, an indicator may be energized to notify the operator that an inappropriate ink stick has been loaded into the port and should be removed. The indicator may be a light emitting device or it may be a sound emitting device. Alternatively, the processor controlling the printer may display on the control panel display 16 (FIG. 1) a message indicating an error has occurred in the loading of an ink stick into an insertion port for a feed channel and the problem with the ink stick. A message may be displayed on the unit or a remote panel. For example, the message may indicate the ink stick is not the correct color for the feed channel. The operator then must remove the ink stick from the insertion port. Otherwise, the passage barrier 104 remains in the blocking position.

Figure 5:
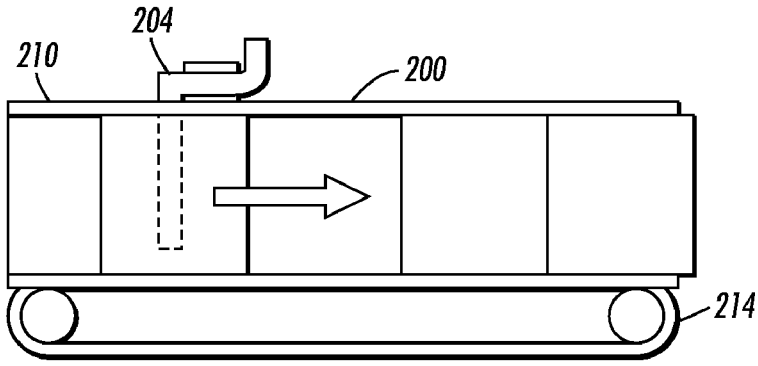
FIG. 5 is a side view of horizontally oriented feed channel having a passage barrier and a mechanized carrier for ink sticks in the feed channel.

As shown in FIG. 4, gravity moves the ink stick 108 into the feed channel 100 in response to the passage barrier 104 being moved out of the feed channel 100. In another embodiment shown in FIG. 5, the passage barrier 204 moves out of the feed channel 200 to enable the ink stick 208 to enter the feed channel 200. Movement of the ink stick from the insertion port 210 into the feed channel 200, however, is performed by the endless belt conveyor 214. The motor or other actuator operating the conveyor 214 may be energized by a processor or other control component in response to an ink stick being identified as corresponding to the feed channel 200. Other types of conveyors may be used in a feed channel to move solid ink sticks, such as walking beams, pushers, leadscrews, or the like.

Figure 6:
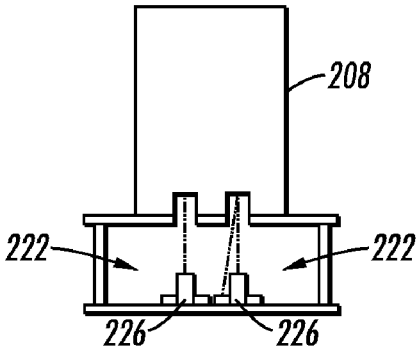
FIG. 6 is a perspective view of an optical sensor that may be used to obtain ink stick identification data in the insertion ports of FIG. 4 and FIG. 5.

The sensors 120 may be optical sensors, radio frequency identification data sensors, mechanical sensors, or the like. An optical sensor for an insertion port is shown in FIG. 6. The optical sensor 222 includes an optical source and detector 226. The sensor positioned in the port to illuminate identification data from the ink stick 208 and provide it to the processor in the printer. The identification data is embodied in the light reflected from the illuminated surface of an ink stick in the insertion port. The reflected light may be modulated by a bar code printed directly on the ink stick surface or the intensity of the reflected light may be varied by the surface structure of the ink stick. In response to the reflected light, the optical detector of the sensor 222 generates an electrical signal corresponding to the identification data on the solid ink stick. In a similar manner, a radio frequency identification data may be incorporated in an ink stick. In this example, the sensor(s) 120 include a radio frequency interrogator for receiving an electrical signal modulated with the radio frequency identification data from the ink stick in the insertion port. These identification data are processed in a manner similar to the identification data obtained with the optical sensor as discussed more fully below.

Figure 7:
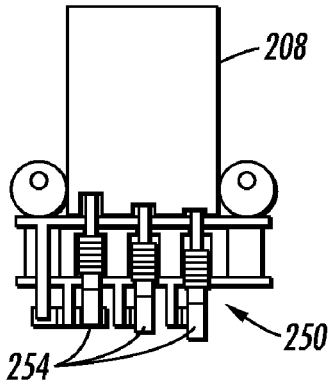
FIG. 7 is a perspective view of a mechanical sensor that may be used to obtain ink stick identification data in the insertion ports of FIG. 4 and FIG. 5.

Although the discussion below relates to an optical sensor, a mechanical sensor that interacts with structural features of solid ink sticks may be used to generate an electrical signal indicative of the identification data for a solid ink stick. An example of such a mechanical sensor is shown in FIG. 7. The sensor 250 includes a plurality of spring biased actuators 254 that interact with the surface of an ink stick in an insertion port. The extension of the actuators interacting with the surface of the ink stick is detected and used to generate an electrical signal corresponding to the ink stick identification data for the ink stick. This signal is provided to a processor for the ink stick identification process as described below.

Figure 8:
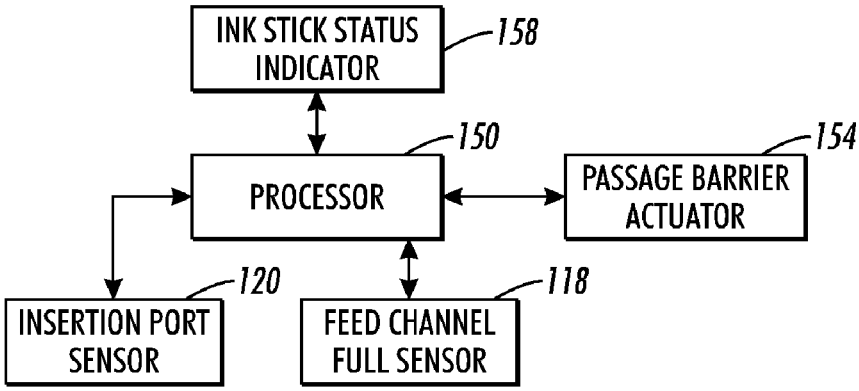
FIG. 8 is a block diagram view of a system that implements the ink stick identification and blocking system.

A system that identifies whether an ink stick corresponds to the feed channel coupled to an insertion port in which an ink stick has been placed is shown in FIG. 8. A processor 150 within the printer receives the electrical signal from the sensor(s) 120 mounted in the insertion port. With reference to the optical sensor 222, for example, the optical detector of the sensor 222 generates an electrical signal corresponding to the ink stick identification data incorporated in the reflected light and compares the identification data obtained from the electrical signal to identification data for ink sticks stored in a memory of the printer. If the identification data obtained from the solid ink stick corresponds to the identification data stored for the feed channel, the processor 150 generates a signal to operate the passage barrier actuator 154 to move the passage barrier out of the feed channel and enable the ink stick to move into the feed channel. As noted above, the processor may rotate the passage barrier by activating a motive force for a drive mechanism (not shown) that is coupled to the passage barrier 104. The drive mechanism may include a stepping motor or other electromechanical source of motive force that is coupled to a leadscrew or other traction drive to move the passage barrier. If an ink stick conveyor, such as conveyor 214 is required for ink stick movement, the processor 150 generates a signal that energizes the actuator for moving the conveyor to transport the ink stick past the passage barrier. The sensor 118 generates a feed channel full signal as the stick moves past the sensor. In response to the feed channel full signal, the passage barrier returns to the feed channel blocking position. If the stick continues past the sensor 118 until the sensor 118 no longer detects the stick, then the sensor terminates generation of the feed channel full signal. As long as no feed channel full signal is being generated by the sensor 118, the passage barrier 104 remains enabled for movement out of the feed channel to enable the ingress of the next ink stick that is identified as corresponding to the feed channel coupled to the insertion port. In response to a feed channel full signal from the sensor 118 following the return of the passage barrier to the blocking position, the passage barrier is disabled from further movement out of the feed channel. Only upon the ink stick moving sufficiently past the sensor 118 that the feed channel full signal is no longer generated by the sensor 118 is the processor 150 enabled to generate a signal to energize the passage barrier actuator and move the passage barrier from the blocking position. For those ink sticks not having identification data that corresponds to the feed channel coupled to the insertion port, the processor 150 does not energize the passage barrier actuator so the passage barrier remains in the blocking position. The processor 150 may also energize indicator 158 to notify the operator that the non-corresponding ink stick must be removed. As described above, the non-corresponding ink stick may be retrieved through the opening of the insertion port. In the embodiment shown in FIG. 5, the conveyor 214 may be operated in the reverse direction to remove the ink stick from the insertion port 210, for example.

In embodiments in which an electrical motor is coupled to a movable drive, such as an auger, leadscrew, or push rod, the rotational output of the motor, which may be bidirectional, may be coupled to the movable drive through one or more gears. The gears may be employed to attain an appropriate speed range for the linear movement of a pushrod or rotation of an auger. Additionally, the gears may be used to change the direction of the rotational input by the motor.

In the embodiments described above, the processor configured to perform the identification process and operate the solid ink passage barrier may be the controller for the printer or a separate controller for operating the ink stick identification and blocking system. The controller may be a general purpose processor having an associated memory in which programmed instructions are stored. Execution of the programmed instructions enables the controller to obtain data from the sensor in the single insertion port, identify the solid ink stick, and operate the ink stick passage barrier to enable the ink stick in an insertion port to move into the feed channel coupled to the insertion port. The controller may, alternatively, be an application specific integrated circuit or a group of electronic components configured on a printed circuit for operation of the identification and blocking system. Thus, the controller may be implemented in hardware alone, software alone, or a combination of hardware and software.

Those skilled in the art will recognize that numerous modifications can be made to the specific implementations described above. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

We claim:

1. A system for providing solid ink to a printer comprising:

a plurality of feed channels, each feed channel having an insertion port at one end of the feed channel and a melting device that heats solid ink sticks to a melting temperature at another end of the feed channel, each feed channel being configured to direct movement of solid ink sticks from the insertion port to the melting device; and each insertion port having at least one sensor, the one sensor being configured to obtain identification data from a solid ink stick received in the insertion port to enable identification of the solid ink stick and an ink stick passage barrier configured to move into and out of the feed channel to block solid ink sticks from entering the feed channel from the insertion port in response to the identification data obtained from the solid ink stick failing to correspond to identification data for solid ink sticks configured to move through the feed channel connected to the insertion port.

2. The system of claim 1, the sensor for at least one insertion port further comprising:

an optical source configured to illuminate the identification data on a portion of the ink stick received in the insertion port;

an optical detector configured to receive light from the optical source that has been reflected by the ink stick and to generate an electrical signal corresponding to the reflected light; and a processor for comparing the electrical signal generated by the optical detector to identification data for solid ink sticks configured to move through the feed channel connected to the insertion port to identify the ink stick received in the insertion port.

3. The system of claim 1, at least one sensor further comprising:

a mechanically displaceable actuator positioned to interact with a solid ink stick received in the insertion port and configured to generate an electrical signal indicative of the actuator interacting with the solid ink stick received in the single insertion port; and a processor configured to compare the electrical signal generated by the mechanically displaceable actuator to identification data for solid ink sticks configured to move through the feed channel connected to the insertion port to identify the ink stick inserted in the insertion port.

4. The system of claim 1, at least one insertion port further comprising:

a displaceable cover configured with reference to the at least one insertion port to expose the at least one insertion port selectively and to activate the sensor for identifying the solid ink stick received in the at least one insertion port.

5. The system of claim 1, each insertion port being configured to receive ink sticks in a direction transverse to a direction of ink stick movement in the feed channel.

6. The system of claim 1, each insertion port being configured to receive ink sticks in a direction aligned with a direction of ink stick movement in the feed channel.

7. The system of claim 1 further comprising:

a feed channel sensor operatively connected to the ink stick passage barrier, the feed channel sensor being configured to generate a feed channel full signal in response to an ink stick being detected at a feed channel full position in the feed channel, the ink stick passage barrier being disabled from moving out of the feed channel in response to the feed channel full signal.

8. The system of claim 7 further comprising:

an indicator configured to indicate an ink stick in one of the insertion ports is being blocked by the ink stick passage barrier in the feed channel coupled to the one insertion port in which the ink stick is being blocked by the ink stick passage barrier.

9. The system of claim 8 wherein the indicator emits light to indicate the ink stick in the one insertion port is being blocked.

10. The system of claim 8 wherein the indicator emits sound to indicate the ink stick in the one insertion port is being blocked.

11. A method for providing solid ink to a melting device in a solid ink printer comprising:

receiving solid ink sticks in an insertion port located at one end of a feed channel in the solid ink printer, the feed channel being configured to direct movement of solid ink sticks to a melting device at a second end of the feed channel;

obtaining identification data from each ink stick received in the insertion port; and removing a passage barrier positioned between the insertion port and the feed channel in response to the ink stick from which identification data was obtained is identified as corresponding to ink sticks configured for passage through the feed channel to the melting device at the second end of the feed channel.

12. The method of claim 11, the ink stick identification further comprising:

illuminating the identification data on a portion of an ink stick received in the insertion port;

receiving light reflected by the portion of the ink stick having the identification data;

generating an electrical signal corresponding to the received reflected light; and comparing the generated electrical signal to identification data for solid ink sticks configured for passage through the feed channel connected to the insertion port to identify the solid ink stick inserted in the insertion port

13. The method of claim 11, the ink stick identification further comprising:

generating an electrical signal indicative of an interaction between identification data on a portion of an ink stick received in the insertion port and an actuator proximate the insertion port; and comparing the generated electrical signal to identification data for solid ink sticks configured for passage through the feed channel connected to the insertion port to identify the ink stick inserted in the insertion port.

14. The method of claim 11 further comprising:

displacing a cover over the insertion port to expose the insertion port and to activate a sensor used to obtain identification data from the ink stick received in the insertion port.

15. The method of claim 11, the ink stick reception further comprising:

receiving ink sticks in the insertion port in a direction transverse to a direction of ink stick movement in the feed channel.

16. The method of claim 11, the ink stick reception further comprising:

receiving ink sticks in the insertion port in a direction aligned with a direction of ink stick movement in the feed channel.

17. The method of claim 11 further comprising:

generating a feed channel full signal in response to an ink stick being detected at a feed channel full position in the feed channel; and disabling removal of the passage barrier between the insertion port and the feed channel in response to the feed channel full signal being generated.

18. The method of claim 17 further comprising:

energizing an indicator to indicate an ink stick in the insertion port is being blocked from entering the feed channel coupled to the insertion port.

19. The method of claim 18 further comprising:

emitting light from the indicator in response to the indicator being energized.

20. The method of claim 18 further comprising:

emitting sound from the indicator in response to the indicator being energized.

* * * * *